United States Patent [19]

Katchka et al.

[11] 4,285,662

[45] Aug. 25, 1981

[54] GAS BURNER CONTROL MECHANISM

[75] Inventors: Jay R. Katchka, Cypress; Marvin M. Graham, Westminster, both of Calif.

[73] Assignee: Robertshaw Controls Company, Richmond, Va.

[21] Appl. No.: 934,533

[22] Filed: Aug. 17, 1978

[51] Int. Cl.[3] ..... F23Q 9/08

[52] U.S. Cl. ..... 431/53

[58] Field of Search ..... 431/46, 53, 54, 80, 431/51, 22

[56] References Cited

U.S. PATENT DOCUMENTS

| | | | |
|---|---|---|---|
| 2,478,386 | 8/1949 | Gauger | 431/54 |
| 2,578,194 | 12/1951 | Matthews | 431/54 |
| 2,889,872 | 6/1959 | Suesserott | 431/54 |
| 3,108,630 | 10/1963 | Forniti | 431/54 |
| 3,290,178 | 12/1966 | Loveland | 431/80 |
| 3,508,708 | 4/1970 | Caparone et al. | 236/33 |
| 4,073,611 | 2/1978 | Kaduki et al. | 431/54 |
| 4,086,048 | 4/1978 | Carlson | 431/54 |
| 4,145,180 | 3/1979 | Bendorf | 431/46 |

FOREIGN PATENT DOCUMENTS

| | | | |
|---|---|---|---|
| 204778 | 1/1955 | Australia | 431/22 |

*Primary Examiner*—Carroll B. Dority, Jr.

*Attorney, Agent, or Firm*—Fulwider, Patton, Rieber, Lee & Utecht

[57] ABSTRACT

There is disclosed a control system for a gas fired main and pilot burner assembly of an appliance. The assembly comprises first and second serially connected gas control valves for installation in the gas line to the main burner. A bypass conduit is provided downstream of the first control valve communicating with the pilot burner. A flame sensor such as a thermocouple is mounted adjacent the pilot burner for direct contact with the flame therefrom are included in the system. The valve members of each of the first and second control valves are resiliently biased closed and an independent latching mechanism is provided with each valve structure to hold its respective valve member open. The latching mechanism of each valve is operatively interconnected to the flame sensor so that the valve members are latched in the valve open positions when a flame is present at the pilot burner.

7 Claims, 7 Drawing Figures

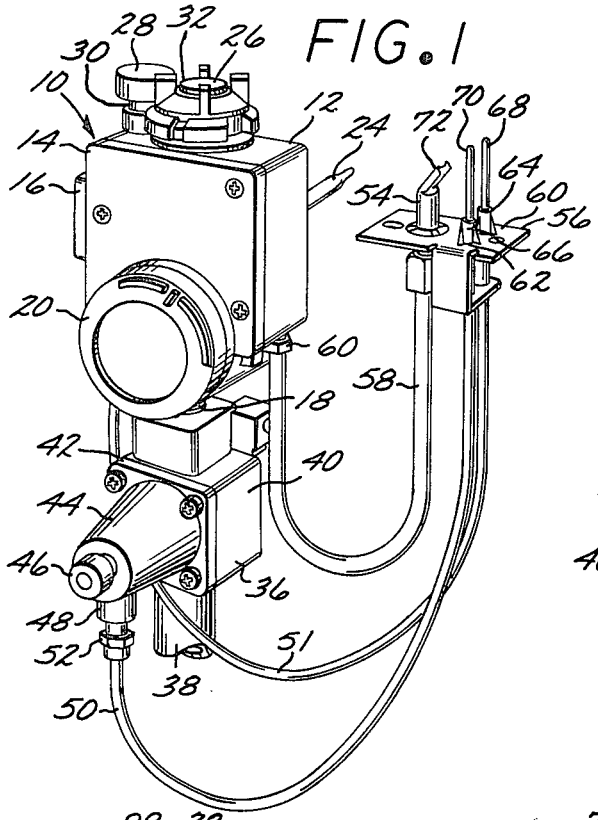
FIG. 1
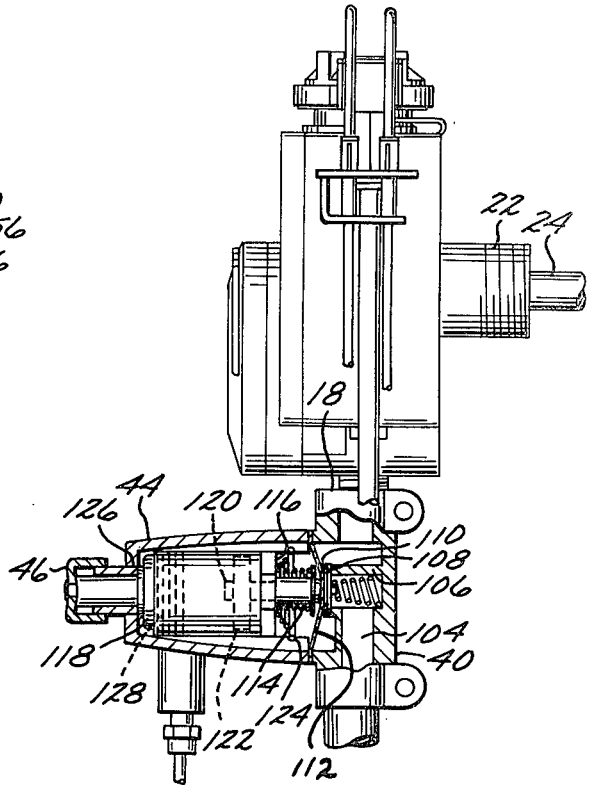
FIG. 3
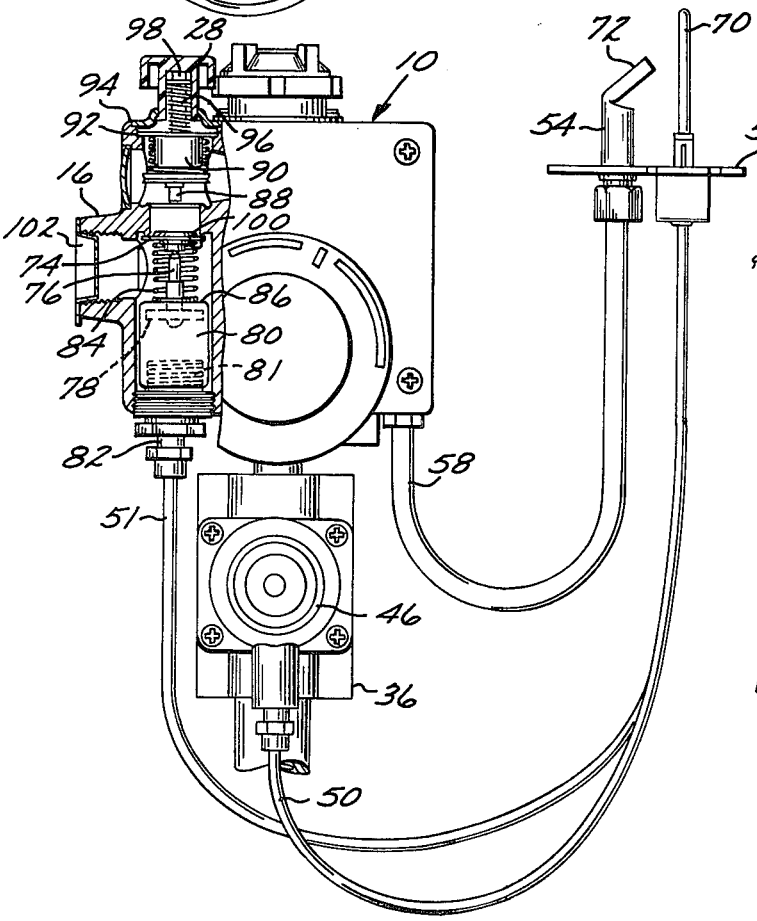
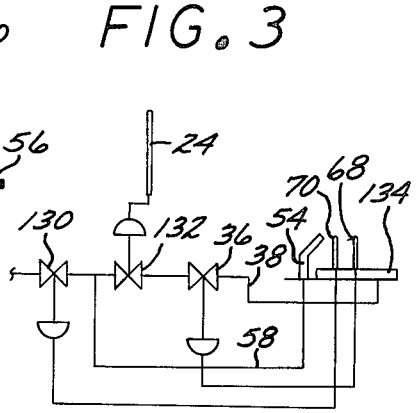
FIG. 4
FIG. 2

FIG. 5
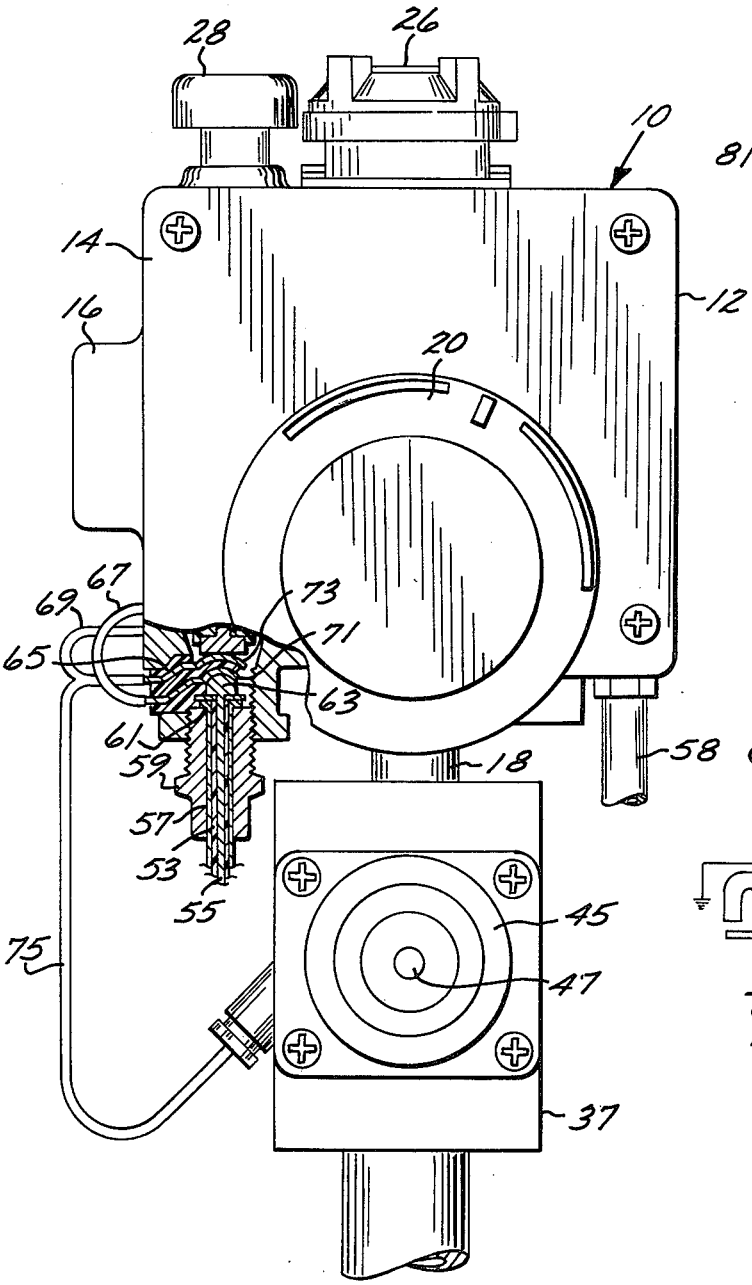
FIG. 6
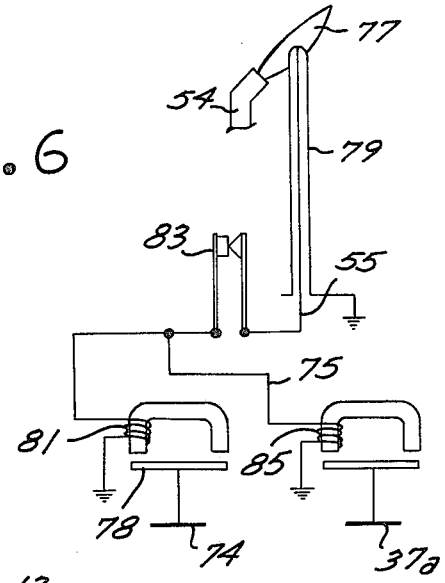
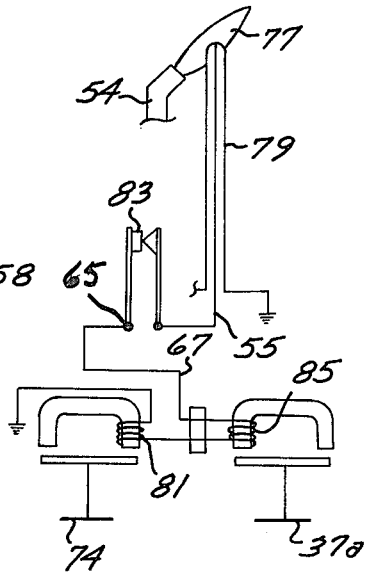
FIG. 7

GAS BURNER CONTROL MECHANISM

BACKGROUND OF THE INVENTION

This invention relates to a control system for a gas burner and, in particular, to a control system for a pilot and main gas burner assembly.

The ubiquitous control system for gas fired appliances such as a water heater comprises a single control valve having a thermostatic actuator. The appliance commonly employs a pilot burner and a main burner, each of which have separate gas supply conduits extending from the first control valve. The first control valve is a unitary structure which has a thermostatically actuated valve member in the supply line to the main burner whereby the gas supply to the main burner responds to the temperature of the appliance, e.g., the temperature of water in the water heater. A flame sensor such as a thermocouple is mounted for direct contact of the flame generated by the pilot burner and the thermocouple is connected directly to a latching mechanism that includes an electromagnetic coil. The valve structure includes a spring biased, manually moveable push rod to unseat the valve member and move its magnet armature into the magnetic field of the electromagnetic coil where it is retained as long as the thermocouple continues to generate sufficient electromotive force from exposure to the flame at the pilot burner.

It is desirable to provide redundant shutoff valve means in the gas supply line to the main burner. The redundant valve means provides an increased safeguard against leakage of gas by a malfunctioning gas valve. It can also serve as a high temperature shut off by connection to a high temperature limit switch (ECO). Desirably, this second or redundant valve should only be operative in the event of a loss of flame at the burner assembly, thereby preventing any accumulation of an ignitable gas mixture. This redundant valve mechanism is particularly desirable for use with combustible gases of greater density than air, e.g., propane, butane, etc., since these gases do not readily disperse when released from the burner.

BRIEF DESCRIPTION OF THE INVENTION

This invention comprises first and second gas shutoff valves for serial connection in the gas line to the main burner of an appliance having a pilot and main burner assembly. Both first and second valves have valve members which are resiliently biased to a closed position and have independent latching mechanisms to retain the valve members in an open position. The latching mechanisms are connected to a common or separate flame sensor such as a thermocouple which can be mounted on a bracket carried by the appliance for direct contact by the flame of the pilot burner. The pilot burner is supplied with gas from a gas line that connects downstream of the first control valve, bypassing the second control valve of the invention. The control system, of course, also employs the thermostatically controlled gas valve in the gas line to the main burner.

BRIEF DESCRIPTION OF THE FIGURES

The invention will be described with reference to the drawings of which:

FIG. 1 is a perspective view of a control system and pilot burner using separate flame sensors for each control valve;

FIG. 2 is an elevational view of the assembly of FIG. 1 with the first control valve shown in sectional view;

FIG. 3 is an elevational view of the system of FIG. 1 with the second control valve in sectional view;

FIG. 4 is a schematic of the control system of FIG. 1.

FIG. 5 is a view of a control valve assembly for use in a system having a single, common flame sensor for the two control valves; and FIGS. 6 and 7 are electrical schematics of control systems using the valve assembly of FIG. 5.

DESCRIPTION OF PREFERRED EMBODIMENTS

Referring now to FIG. 1, the invention is applied to a control valve assembly commonly used in a water heater. This control valve assembly generally designated as 10, is described in greater detail in U.S. Pat. No. 3,508,708 of Apr. 28, 1970, which is incorporated herein by reference. Briefly, this valve assembly comprises a box housing 12 with a coverplate 14 and a lateral boss 16 for connection to a gas supply line and an internally threaded gas discharge port in its undersurface for attachment of a threaded outlet conduit 18. The front cover 14 bears a rotatable control knob 20 and the rear wall of box 12 supports an externally threaded fitting 22 (see FIG. 3) for mounting of the control valve assembly to the appliance, commonly in a threaded aperture of a water heater vessel with the thermostatic probe 24 extending into the water heater vessel. The upper surface of box 12 rotatably supports a control knob 26 and a depressable button 28 on push rod 30.

The control knob 26 is utilized during ignition of the burner system and functions in the same manner as described in the aforesaid prior patent. Accordingly, the structure of the valve mechanism controlled by knob 26 is not described in detail, herein. Briefly, the valve mechanism is operable during ignition of the burner by rotation of the control knob to a "pilot" position where a relieved portion 32 of peripheral flange 34 of control knob 26 is aligned with button 28, clearing this button and permitting it to be depressed.

The assembly of the invention also includes gas control valve 36 in the main fuel supply line 38 which extends to the main gas burner. This valve structure has a housing 40 with a cover plate 42 bearing an upright boss 44 which slidably receives a button 46 that is resiliently biased outwardly. The boss 44 has an offset neck 48 for threaded connection to coaxial lead 50 by threaded connector 52.

The pilot burner 54 is mounted on a bracket 56 for attachment to the appliance or main gas burner. The pilot burner has a gas supply conduit 58 which extends from a threaded attachment 60 to the control valve 10. The mounting bracket 56 has a pair of spaced-apart apertures 60 and 62 which receive sleeves 64 and 66 which have slit bases that snap into engagement with bracket 56. The thermocouples 68 and 70 of the assembly are mounted adjacent to pilot burner 54 and the latter has a shield 72 with a flat face to deflect the flame at the pilot burner towards the pair of thermocouples 68 and 70.

Referring now to FIG. 2, the control valve assembly 10 is shown in partial sectional view, illustrating the safety shutoff valve mechanism of its control shut-off valve.

The shut-off valve mechanism of the assembly comprises a valve member 74 which is carried on valve rod 76 which bears, at its opposite end, the armature 78 for the electromagnetic latching means of the valve structure. The armature is contained within cylindrical casing 80 and is slidably received therein. Casing 80 contains an electromagnetic coil 81 which is in electrical continuity to the coaxial thermocouple lead 51 that extends from thermocouple 68. This thermocouple lead 51 is a conventional coaxial thermocouple lead having an outer grounding conductor which is threadably secured in electrical contact to one lead of the electromagnetic coil by threaded connector 82 and which has an internal, coaxial and electrically isolated conductor that makes contact to the other terminal of coil 81.

The valve member 74 is resiliently biased to the closed, illustrated position by helical coil spring 84 which coaxially surrounds valve rod 76 and is captured between valve member 74 and the end wall 86 of cylindrical casing 80.

The manual actuator for the valve member 74 comprises rod 88 which is slidably mounted in the top wall of the box 12 housing the control valve. To this end, rod 88 passes through cup 90 having an upper peripheral lip 92 which is seated in bore 94 in the top wall of the housing 12. A resilient helical coil spring 96 is captured between the bottom wall of cup 90 and a spring retainer 98 mounted on shaft 88, thereby biasing the shaft 88 upwardly in the illustration. Button 28 has a central bore to receive the pushrod 88 and coaxial helical coil spring 96.

The operation of the control valve of the valve structure 10 is fairly apparent from the preceding description. The operator manually depresses button 28 to bottom push rod 88 on the upper face of valve member 74 and the continued depressing of this button lifts the valve member from its annular seat 100, permitting gas to flow from the inlet port 102 in boss 16 past the valve seat 100. This gas is then passed through the remaining valve structure to the pilot gas conduit 58 and to pilot burner 54 where the gas is ignited. The flame heats the thermocouples 68 and 70 and the resulting direct current voltage developed by the thermocouple 68 is transmitted through coaxial lead 51 to the coil 81 of the electromagnetic latching means. The upper face of the coil 81 is in contact with the armature 78 and the magnetic field developed by the coil 81 is sufficient to hold the armature in this position against the bias of spring 84 when the operator releases button 28. In this fashion, the electromagnetic coil 81 serves as a latching means to latch open valve member 74.

Referring now to FIG. 3, the second shutoff valve mechanism used in the invention will be described. As there illustrated, the gas conduit 18 is connected to the valve housing 40. The valve member has its outlet port 104 in communication with a central boss 106 on the inside wall of the valve housing 40. The upper end of boss 106 provides a valve seat 108 for valve member 110 which is carried on a flexible diaphragm 112. Valve member 110 is resiliently biased into a closed registration with valve seat 108 by a helical coil spring 114 which is biased between the outer face of valve member 110 and the end wall 116 of cylindrical casing 118. The valve member 110 engages the end of valve rod 120 which bears on its opposite end, armature plate 122 of an electromagnetic latching means. Cylindrical casing 118 is slidably received within the boss 44 of the valve housing and is resiliently biased into the illustrated position by a helical coil spring 124. Push button 46 is slidably received within the through bore 126 of boss 44 and bears against the outer end wall of cylindrical casing 118. The electromagnetic coil 128 of this valve member is mounted in casing similar to coil 81 of the previously described cylindrical casing 80. This coil is in electrical contact with the coaxial thermocouple conductor 50 which extends to thermocouple 70, previously described.

The operation of the second control valve is apparent from the preceding description. The operator depresses button 46 which moves cylindrical casing 118 inwardly, against the bias of coil spring 124. This positions the electromagnetic coil 128 adjacent the armature 122 that is carried on the valve rod 120. When thermocouple 70 is heated sufficiently to generate the required voltage, electromagnet 128 latches armature 120 such when button 46 is released, the entire assembly of casing 118, armature 122, valve rod 120 and valve member 110 are moved to the left in the illustrated view, thereby unseating valve member 110 from seat 108 and permitting gas to flow from conduit 18 through the valve inlet port into cylindrical boss 106 and through the outlet port 104 of the valve structure. The release of the valve member armature 122 such as caused by failure of the pilot burner flame, will permit the valve member to close under the resilient bias of its helical coil spring 114.

As described in the aforementioned prior patent, the valve housing 12 also contains a gas control valve that responds to the thermostatic actuator 24. The schematic of the flow control valves are shown in FIG. 4 as comprising the first valve 130, which is the valve shown in sectional view of FIG. 2, and the second valve 36. The valve housing 12 also includes the thermostatically actuated valve 132 that responds to the thermostatic actuator 24. The main burner is generally indicated at 134 in the illustration and receives gas through the main supply conduit 38 which is discharged through the three valves 130, 132 and 36. The pilot burner 54 receives gas through the pilot burner supply conduit 58 which is downstream of the first control valve 130 but which bypasses the thermostatically controlled valve 132 and the second safety shutoff valve 36.

The control valve shown in FIG. 5 and the control systems shown in FIGS. 6 and 7 utilizing such control valve is intended for operation with a single flame sensing device. The control valve 10 shown in FIG. 5 is of the same construction as that described with regard to FIG. 1, including a body 12, front plate 14, control knob 26, push button 28, and main burner gas outlet conduit 18. The body 12 also includes the lateral boss 16 for the gas inlet to the valve and has the control knob 20 for the variable setting of the response of the main gas control valve to the thermostatic assembly (not shown, but identical to assembly 24 of FIG. 1).

The control valve also has the outlet with a conduit 58 for supplying gas to the pilot burner. The conduit 18 is fitted with a gas control valve 37 which has a push button 47 operator similar to button 46 described with reference to valve 36 shown in FIGS. 1–4. This button 47 is slidably mounted in a boss 45 of construction similar to boss 44 of the valve housing 36 previously described.

The single thermocouple connector is in the form of a coaxial cable 53 having a center conductor core 55 and an outer grounding conductor 57 separated by suitable insulation. This conductor is received in the through bore of plug fitting 59 and is secured therein by an outer flange 61 of the grounding conductor 57 and a deformed cap 63 for the central conductor.

The assembly includes an electrical terminal 65 which is of the construction and operation described in U.S. Pat. No. 3,286,216, to install in the thermocouple input circuit a safety switch (not shown). The safety switch is connected to conductors 67 and 69 which are received within the electrical terminal 65. Conductor 67 terminates within electrical terminal 65 in a deformed extremity 71 which overlies and is in electrical continuity with the end cap 63 of central conductor 55. Conductor 69 is received in electrical terminal 65 with a deformed extremity 73 which like extremity 71, is disposed on the longitudinal axis extending into the terminal body and generally coaxial with central core 55. The deformed extremities 71 and 73 comprise flattened shapes that are slightly bowed as shown and are spaced apart by an interspaced portion of the body of electrical terminal 65, which is an electrical insulator. In this fashion, the electrical continuity through the electrical terminal extends from central core 55, through conductor 67 to the remote safety element such as a normally closed switch or fusible member. These devices are commonly used and referred to as energy cutoff devices (ECO). The devices are immersed in the water of the water heater tank and operate as a safety element to prevent excessive heating of the water.

The aforementioned structure is modified in accordance with the invention by providing the conductor 75 which extends from lead 69 to the holding coil (not shown) of the valve structure 37. The conductor is connected to one terminal of the coil and the other terminal of the coil is grounded to the metallic case of valve 37 which is in electrical continuity to body 12 of valve 10.

Referring now to FIG. 6, the electrical schematic of the control valve structure and system will be described. As there illustrated, the pilot burner 54 produces a flame 77 which contacts the thermocouple 79. The thermocouple is connected through the central conductor 55, through the ECO safety switch 83 and to the holding coil 81 of the first valve structure. This coil is operative to hold the armature 78 and mechanically connected valve member 74 of the first control shut-off valve in an open position.

The conductor 75 extends to the holding coil 85 of the second control shut-off valve 37 and is operative of the second control shut-off valve 37 and is operative to maintain its valve member **37*a* in an open position. Upon the failure of flame 77, or the opening of the contacts of the ECO switch 83, the electromagnetic coils 81 and 85 release their associated armatures permitting valve members 74 and 37*a*** to close.

The circuit illustrated in FIG. 6 is designed with the use of coils 81 and 85 which have individual resistances in the range of about 0.025 to about 0.05 ohms instead of the conventional range of about 0.015 to 0.02 ohms. The two coils in parallel in the latter range making the combined external resistance substantially the same as that of a conventional single valve coil.

The operator coils of the two shut-off control valves can also be connected serially as shown in FIG. 7. As shown in FIG. 7, the central conductor 55 is connected through a lead, such as the lead 67 from the electrical terminal 65 through the energy cut-off switch 83 to the coil 85 of the second control valve 37, then to the coil 81 of the first shut-off valve. In this embodiment, coils can be used with resistances in the range of 0.015 to 0.02 ohms. In operation, the flame 77 at pilot burner 54 contacts thermocouple 79. The electrical output of the thermocouple is applied, through the ECO safety switch 83 to the holding coils of the valves, maintaining the valve closure members **37*a* and 74** in open positions.

The use of the second or redundant safety valve of the invention provides an extra margin of safety in the gas fired appliance. This valve employs a completely independent latching mechanism to insure true redundancy and a margin of safety in the assembly.

The invention has been described with reference to the illustrated and presently preferred embodiment. It is not intended that the invention be unduly limited by this disclosure. Instead, it is intended that the invention be defined by the means, and their obvious equivalents, set forth in the following claims.

What is claimed is:

1. A control system for a gas fired appliance having a main burner and a single pilot burner, said control system comprising:

first and second gas control valves for serial connection in a gas supply line to said main burner of said appliance, said second gas control valve being located downstream of said first gas control valve, each valve having a valve member resiliently biased closed and independent electromagnetic valve member latching means energizable to hold each valve member open, and deenergizable to allow each valve member to close, each of said valves including manual operating means to engage the valve member thereof with its respective latching means;

conduit means coupled to said gas supply line between said first and second control valves, bypassing said second gas control valve, and in communication with said pilot burner of said appliance to supply gas thereto from said gas supply line;

thermocouple type flame sensing means;

bracket means to mount said flame sensing means adjacent said pilot burner for contact by the flame thereof; and electrical conductors operatively connecting said flame sensing means to each of the latching means of the respective said first and second gas control valves for energization of said latching means upon heating of said flame sensing means by the flame of said pilot burner to hold open both said valve members of said first and second gas control valves, said latching means of both said first and second gas control valves being deenergized in the absence of said flame whereby both said valve members of said first and second gas control valves are biased closed and gas flow through both said conduit means and said gas supply line is cut off.

2. The control system of claim 1 wherein said manual operating means are spring biased depressable buttons.

3. The control system of claim 1 wherein said flame sensing means comprises a single thermocouple and said conductors serially interconnect the latching means of said first and second valves.

4. The control system of claim 1 wherein said flame sensing means comprises a single thermocouple and said conductors interconnect said latching means of said first and second valves in parallel circuits.

5. The control system of claim 1 wherein said flame sensing means comprises first and second thermocouples and said conductors provide independent and separate circuits to respective latching means of said first and second valves.

6. The control system of claim 1 including a thermostatically controlled valve connected in said gas supply line in series with said first and second valves.

7. The control system of claim 1 including temperature responsive, normally closed switch means in circuit with said flame sensing means and said latching means.

* * * * *